United States Patent [19]

Fuchs

[11] Patent Number: 4,986,728

[45] Date of Patent: Jan. 22, 1991

[54] FUEL INJECTION PUMP FOR INTERNAL COMBUSTION ENGINES

[75] Inventor: Peter Fuchs, Adlikon, Switzerland

[73] Assignee: Nova-Werke AG, Switzerland

[21] Appl. No.: 269,734

[22] PCT Filed: Jan. 25, 1988

[86] PCT No.: PCT/CH88/00014

§ 371 Date: Sep. 27, 1988

§ 102(e) Date: Sep. 27, 1988

[87] PCT Pub. No.: WO88/05863

PCT Pub. Date: Aug. 11, 1988

[30] Foreign Application Priority Data

Jan. 30, 1987 [CH] Switzerland ..... 330/87

[51] Int. Cl.[5] ..... F02M 59/30

[52] U.S. Cl. ..... 417/443; 92/85 B; 173/506

[58] Field of Search ..... 123/506, 467; 92/85 B; 417/443, 446, 501, 520

[56] References Cited

U.S. PATENT DOCUMENTS 4,699,112 10/1987 Filippi et al. ..... 123/506

FOREIGN PATENT DOCUMENTS

| | | | |
|---|---|---|---|
| 655171 | 12/1937 | Fed. Rep. of Germany | 417/520 |
| 802967 | 2/1951 | Fed. Rep. of Germany . | |
| 863573 | 1/1953 | Fed. Rep. of Germany . | |
| 2348865 | 4/1975 | Fed. Rep. of Germany | 123/506 |
| 3100725 | 7/1982 | Fed. Rep. of Germany . | |
| 3523536 | 3/1986 | Fed. Rep. of Germany . | |
| 71672 | 4/1931 | Sweden | 123/506 |

*Primary Examiner*—Leonard E. Smith
*Assistant Examiner*—Robert N. Blackmon
*Attorney, Agent, or Firm*—Tarolli, Sundheim & Covell

[57] ABSTRACT

A fuel injection pump has a housing (3) with a flange (5) and a bore (40) in which are arranged a sleeve (2) and a pump piston (1). A valve body (4) with a hollow core space (20) is located in an axial end portion of the sleeve (2). The valve body (4) has at both axial end portions (11, 12) hydraulic dampening means. In the zone of the top dead center of the pump piston (1), its head (13) cooperates directly with the axial end portion (11) of the valve body (4), actuating a valve seat (27). This valve seat (27) located between the valve body (4) and the sleeve (2) acts as a fuel intake and relief valve for the fuel delivery system. A fluid spring including a cylinder chamber (42) and an additional piston (44), as well as an actuating element (19), are located adjacent an axial end of the pump piston (1). The actuating element (19) is linked with a drive.

17 Claims, 3 Drawing Sheets

FUEL INJECTION PUMP FOR INTERNAL COMBUSTION ENGINES

BACKGROUND OF THE INVENTION

1. Technical Field

The invention relates to a fuel injection pump for use with an internal combustion engine. The fuel injection pump includes a pump piston guided in a cylinder and having an adjustable stroke, a valve located adjacent an axial end of the pump piston between a cylinder chamber and an injection line and having a valve body which cooperates with the piston pump when the piston pump at a top dead center position, and a device for setting the stroke of the piston pump.

2. Description of the Prior Art

In fuel injection pumps in which the pump piston, at top dead center, cooperates with a valve, the pump piston effects the interruption of the injection process by actuating a valve body. A fuel injection pump of this kind is known from German Disclosure No. 31 00 725 A1. In this publication, especially in connection with FIG. 7, a fuel injection pump is described which has a relief valve actuated by the pump piston. In the fuel injection pump, a fuel chamber is located above a cylinder chamber and is connected through a fuel channel with the cylinder chamber. The relief valve is located parallel to the fuel channel and closes a passage from the fuel chamber into a return line for the fuel delivery system. A valve stem connected with the valve is guided in an upper portion of the cylinder chamber and, at the top dead center position of the pump piston, is in contact with the pump piston. The valve with the valve stem is biased by a spring against a valve seat, that is, in a direction toward the upper portion of the cylinder chamber. At the upper rim of the fuel chamber, located away from the cylinder chamber, is arranged a connection bore which leads into an injection line. The pump piston is driven by corresponding devices, as described also in the publication. During the stroke of the pump piston, the fuel is compressed in the cylinder chamber and forced through the fuel channel into the fuel chamber, and from there into the injection line. On reaching the desired injection pressure, the injection nozzles are released in the known way, and the injection process into the cylinder of the internal combustion engine begins. Before reaching the top dead center position, the end surface of the pump piston touches the end of the valve stem and presses against the relief valve. In this way, a passage between the fuel chamber and a return line is opened, and the pressure in the cylinder chamber, the fuel chamber and the injection line is relieved. As a result of the reduction in pressure, the injection nozzle is closed and the injection process ceases.

In fuel injection pumps which operate at high pressures, for example up to 2500 bar, the forces acting on the pump piston and the relief valve during the injection stroke are very high. Even the final speed of the piston before reaching the top dead center position may be relatively high. At the moment when the pump piston strikes against the stem of the relief valve, therefore, very high surface loads occur between the contact surfaces, which in a short time destroy the contact surfaces and impair the function of the device. Because of the sudden reduction of pressure on the surface of the relief valve, there is also the danger that the pump piston and the relief valve will be shot upward, and that there will be further damage to the pump piston, cylinder chamber and valve arrangements. To prevent this, large hold-back springs must be placed above the relief valve that such valve arrangements can hardly be designed to be controlled mechanically. Suitable arrangements can only be obtained if the carrying speed and also the pumping pressure are considerably reduced and, thus, the forces acting between the pump piston and the relief valve are also less. But reduction of the carrying speed brings known disadvantages, such as large pump pistons and the associated greater leakage, as well as poorer possibility of modulating the speed course of the piston. Lower injection pressures give a poorer atomization of the fuel in the internal combustion engine, and thus a later end of the combustion process. The known device has other disadvantages, since in the area of the relief valve and in the additional fuel chamber, a suction valve must be arranged which makes possible the suction of fuel from the fuel feeding system. The whole arrangement of relief valve, suction valve and connection channel has the result that the upper portion of the pump cylinder must be designed asymmetrical. In this way, with the heating of the cylinder there is danger that the latter will be deformed asymmetrically and in this way the perfect course of movement of the pump piston in the cylinder chamber may be prevented. Also, the high pressures which occur lead to irregular deformations of the upper cylinder part with equal consequences to the pump piston.

SUMMARY OF THE INVENTION

The objects of the present invention are to provide a fuel injection pump, in which (a) the pump piston actuates the valve body of a valve arrangement, without damage occurring to the pump piston or the valve body; (b) the forces occurring in the breakdown of pressure in the injection pump, can be completely broken down without damage to the parts of the injection pump; (c) the sealing with rubber rings, usual up to now, between housing and cylinder, can be eliminated; and (d) the valve arrangement above the pump piston can be designed symmetrical about the pump axis, and in this way, the occurrence of asymmetrical deformations and stresses is avoided, and the valve arrangement allows very high pumping pressures, and simplifies the construction of relief and suction valves.

These objects are attained according to the invention by the fact that a first axial end portion of the valve body projects into the cylinder chamber, and a second axial end portion is located adjacent the injection line in the pump housing. A first hydraulic damping device is located between the pump piston and the first axial end portion of the valve body. A second hydraulic damping device is located adjacent the second axial end portion and brakes movement of the valve body directed away from the pump piston. The valve body is guided in a hollow chamber which is connected between the cylinder chamber and the injection line.

The advantages attained by the present invention are realized because the pump piston, before reaching top dead center, does not strike directly against the first axial end portion of the valve body. But rather, the first hydraulic damping device provides for a damped acceleration of the valve body from zero to a maximum speed. Only when the pump piston and the valve body have the same speed, does the full force of the pump piston act on the valve body. At this time, however, the opening of the relief valve has already begun, and the reduction of pressure in the cylinder chamber and the injection line takes place rapidly. Before reaching the moment of opening of the relief valve, the force acting on the pump piston is also reduced, so that the pump piston can be braked relatively quickly. For this braking process, the second hydraulic damping device is located adjacent the second axial end portion on the valve body, designed in one piece, and provides that the valve body, and thus the pump piston, cannot be shot upward as a result of the high forces acting. The valve body is guided in a hollow chamber which is connected between the cylinder chamber and the injection line. This allows the symmetrical arrangement of the valve body, the hollow chamber surrounding the valve body, and feed lines around the axis of the injection pump.

One preferred embodiment of the invention is distinguished by the fact that the first hydraulic damping device includes a circular hollow chamber arranged in the head part of the pump piston and is open toward the valve body. The diameter of this hollow chamber is slightly greater than the diameter of the portion of the valve body received therein. The axial end surface of the valve body receivable in the hollow chamber lies, at top dead center of the pump piston, against the bottom surface of the hollow chamber, and a gap is formed between the outer periphery of the first axial end portion of the valve body and the inner periphery of the hollow chamber. The ratio of the annular cross sectional area of the gap to that of the pump piston is preferably between 1:500 and 1:1000. In a further development of the invention, the ratio of the diameter of the first axial end portion of the valve body to the diameter of the pump piston is between 1:1.2 and 1:2.5. The diameter of the pump piston is determined by the desired maximum injection pressure and the maximum length of movement possible of the stroke of the pump piston. The diameter of the first axial end portion of the valve body is determined by the allowable surface pressure between the axial end surface of the valve body and the bottom surface of the hollow chamber in the head part of the pump piston with the residual force acting before reaching top dead center. By changing the cross sectional area of the gap, adaptations may be made to the construction data, since changing this gap results in a change of the outflow amount of fuel from the hollow chamber, and thus a change of the moment at which valve body and pump piston come directly in contact with each other mechanically. To adapt the course of movement between valve body and pump piston to the desired requirements, the contact surfaces and/or peripheral surfaces in the contact area may be correspondingly designed. One preferred embodiment of the present invention consists of the fact that the first axial end portion of the valve body has, in the area of the length of penetration into the hollow chamber, a graduated diameter, the maximum diameter in this zone being determined by the gap space. This embodiment makes possible a simpler production of the damping device and an exact adaptation to the operation conditions.

Another embodiment of the invention includes the second hydraulic damping device having a pressure chamber arranged around a portion of the valve body and a guide bore, connecting to this pressure chamber in which the second axial end portion of the valve body is conducted. In the pressure chamber, an annular piston surface is located around the valve body, and between the outer periphery of the second axial end portion of the valve body and the inner periphery of the guide bore is formed a gap. The ratio of the annular cross section area of the gap to the cross section area of the pump piston is between 1:600 and 1:1100. The ratio of the diameter of the second axial end portion of the valve body to the diameter of the pump piston is between 1:1.5 and 1:3. With displacement of the valve body in the direction of the injection line, the fuel which is in the pressure chamber around a portion of the valve body, is compressed by the annular piston surface located around the valve body. The increase of pressure in the fuel in this pressure chamber has the effect, that the fuel flows out between the outer periphery of the second axial end portion of the valve body and the inner periphery of the guide bore into the injection line. The build-up of pressure in the pressure chamber acts first on the valve body, as a spring and then, because of the outflow through the gap, breaks down the accelerations and forces acting on the valve body, until an equilibrium is established. By the proper choice of diameter and the cross sectional area of the gap, and with the aid of known calculation methods, the course of damping can be exactly predetermined. The second damping device acts with self-regulation within a certain range, since with increase of the forces and accelerations acting on the valve body, higher counterforces also occur in the pressure chamber, and the damping takes a correspondingly different course. This arrangement of the damping devices makes possible, therefore, the changing of the operating conditions of the fuel injection pump and the prevention of the unallowable force and acceleration processes in the area of the pump piston and the valve body and consequent damage. Another advantage is that the fuel itself may be used as damping medium and no additional fluid is needed.

In another embodiment of the invention, the valve body has a hollow space at the core. This hollow core space is open at the second axial end portion of the valve body, connected at the first axial end portion of the valve body, through side bores, with the cylinder chamber, and in the zone of the beginning of the guide bore, through side bores with the pressure chamber. The advantage of this arrangement is that the fuel channels, under high pressure, are guided in the center of the fuel injection pump, and any feed and drain channels are arranged radial and symmetrical to same. During the stroke of the pump piston, the pressure chamber adjacent the second axial end portion of the valve body is set under the same pressure as the cylinder chamber, by which axial forces can be compensated.

Another embodiment of the invention is distinguished by the fact that the valve body has a hollow space at the core. This hollow core space is open at both axial ends of the valve body, and in the zone of the beginning of the guide bore is connected through side bores with the pressure chamber. In the hollow chamber of the pump piston, a projection extends from the bottom surface, and this projection is extendable into an axial end of the hollow core space in the valve body. The hollow core space enables an ideal flow for the stream of fuel. All axial and radial forces against the valve body are compensated, so that no asymmetrical loads occur. The closing of the hollow core space by the projection on the pump piston at the top dead center position provides additional damping and prevents the flowing back of fuel in the fuel line to the nozzle.

Another development of the invention is distinguished by the fact that a portion of the valve body is surrounded by a ring space, into which open the bores of the fuel feed lines and fuel drain line. In this ring space, an annular piston surface is located around the valve body, and at an axial end of the ring space, between the valve body and a sleeve, an annular valve seat is formed. The advantages obtained by this arrangement are realized because the same valve seat serves as a relief valve and as a suction valve. During the suction process, that is, the movement downward of the pump piston, the valve body is held in equilibrium by the annular piston surface arranged in this ring space, or the pressure of the fuel feed system acting on this annular piston surface, and the pressure spring arranged in the pressure chamber adjacent an axial end of the valve body. The suction-vacuum produced in the cylinder chamber acts, through the hollow core space in the valve body, on the pressure chamber adjacent the second axial end portion, and effects, with too little an inflow of fuel into the cylinder chamber, an additional opening of the valve seat. By combining the suction valve and the relief valve in one valve seat, the construction of the valve arrangement is much simplified, and there is given the additional advantage of symmetrical arrangement around the axis of the injection pump.

A further improvement of the fuel injection pump can be obtained because the pump piston, the valve body and the guide bore are enclosed by a one-piece sleeve, and the sleeve is fastened only at the upper end of the pump housing, in the axial direction of the pump. This one-piece design of the sleeve, with contact only at one end, brings great advantages, since heat expansions of the sleeve do not lead to a straining of same, and the sleeve itself need not be clamped mechanically in the axial direction. In this way, deformations of the cylinder chamber as a result of any pressure forces acting on the sleeve, are prevented. This leads in turn to less susceptibility to disturbance of the cycle of movement of the pump piston in the cylinder chamber.

In a further development of the invention, the sleeve is at least partly enclosed by the housing. The housing has lengthwise bores which are connected with the fuel feed lines and fuel exit lines, and in the operating condition are filled with fuel, and the one end of the sleeve ends in a pressureless leakage chamber in the housing. By the fuel circulating in these lengthwise bores, the housing and the pump cylinder can be evenly heated over the entire sealing length, and thus, the heat stresses in the housing and the sleeve greatly diminished. The cylindrical contact surfaces between the sleeve and the housing form a metal sealing with a sealing gap which opens into a pressureless leakage chamber. This brings the advantage that no other seals are needed for the sealing between sleeve and housing, in the form of rubber rings, for example. This arrangement also makes possible a much better control of the overflow pressures within the housing.

An improvement of the driving of the pump piston is given by the fact at the one end of the pump piston is arranged an additional piston, and this additional piston is part of a pneumatic or hydraulic spring, which acts against the drive of the pump piston. Moreover, an actuation element of the drive and control device lies loose against an axial end of the pump piston. This drive and control device for pump pistons is known and may, for example, be designed according to FIG. 5 of German Disclosure No. 31 00 725. But is also possible to make the drive mechanical, hydraulic or in another kind of combination. The actuating element, lying loose against the pump piston moves the pump piston during the work stroke. With this, the additional piston is also moved, and in a storage chamber, hydraulic or pneumatic pressure medium is compressed. After reaching top dead center point, this compressured pressure medium effects the return of the pump piston and thus brings the advantage that between drive and control device and pump piston, no mechanical coupling is necessary. The result of this is that the actuation element of the drive and control device, in the area of the bottom dead center of the pump piston, can move independently of the latter, and any variations in the course of movement can be picked up.

A further improvement of the setting of the stroke can be attained by the fact that into the injection line beyond the valve body is located a relief valve with a connection to the fuel circulation. Before putting the injection pump into operation, the pump piston is brought to the top dead center position, since this assures a clear, definite starting position for the pump piston. To prevent fuel from being injected into the cylinder of the internal combustion engine during this movement cycle, the relief valve is opened, and the fuel driven by the pump piston can flow back into the fuel circulation. The setting of the stroke distance of the pump piston takes place now always from top dead center downwardly through the drive and control device. The strokes of the pump piston start, therefore, always from an exactly defined position.

BRIEF DESCRIPTION OF THE DRAWINGS

The invention will be explained in detail below in embodiments, with reference to the attached drawings, in which.

DESCRIPTION OF PREFERRED EMBODIMENTS

Figure 1:
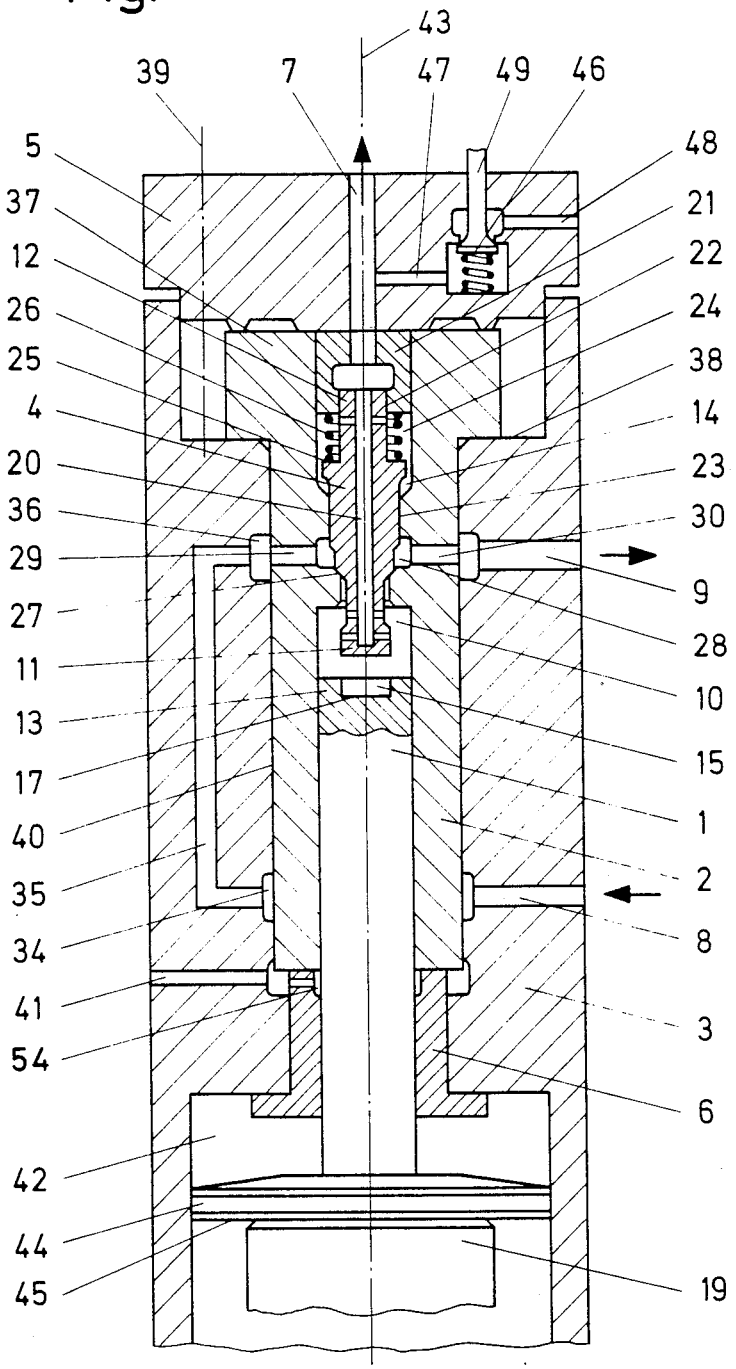
FIG. 1 is a longitudinal sectional view of a fuel injection pump embodying the present invention.

A fuel injection pump for use with a diesel internal combustion engine and which produces injection pressures on the order of 2500 bar is illustrated in FIG. 1. The fuel injection pump includes a housing 3 with an end cap 5. A sleeve 2 is located in the housing 3 and includes a cylinder chamber 10. A pump piston 1 is guided in the cylinder chamber 10 and is connected at its lower axial end with an actuating element 19. The actuating element 19 drives and establishes the stroke of the pump piston 1. The actuating element 19 comprises a known mechanical and/or hydraulic drive and stroke establishing device, for example, according to German Disclosure No. 31 00 725, and is not described in detail. Fuel is fed to the injection pump through fuel feed line 8, and excess fuel is carried away through fuel exit line 9. The fuel in the cylinder chamber 10, compressed and carried by the pump piston 1, is conducted through a hollow core space 20 extending coaxially in a valve body 4 to the injection line 7 and from the injection line to an injection nozzle on the internal combustion engine. As is known, each cylinder of the internal combustion engine has a fuel injection pump.

Figure 2:
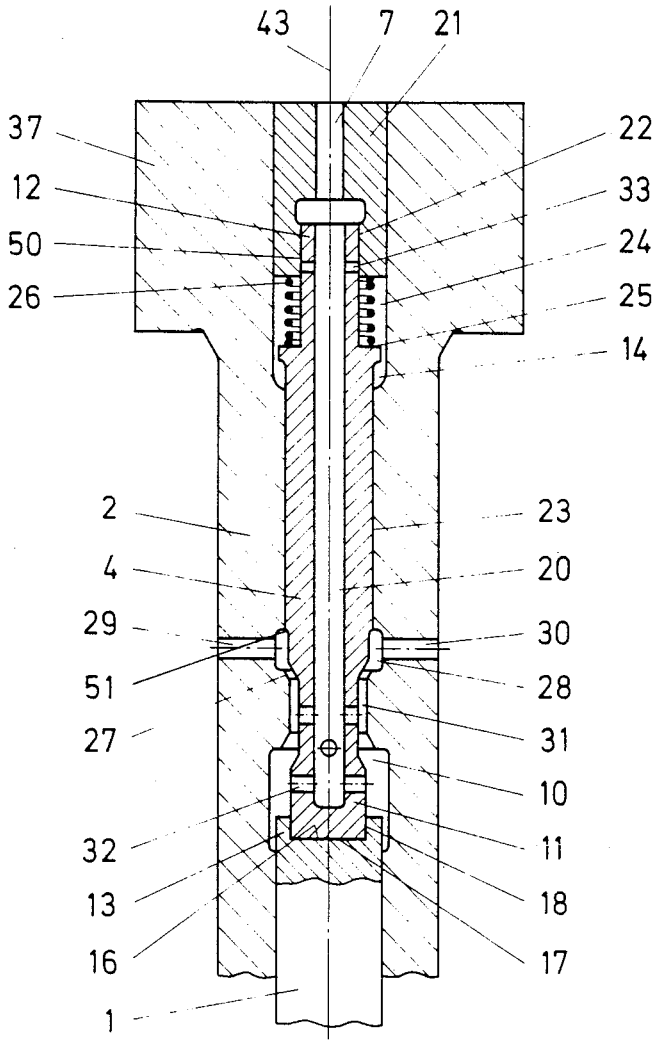
FIG. 2 is an enlarged sectional view of a portion of the fuel injection pump in FIG. 1.

According to FIGS. 1 and 2, the valve body 4 is located in a hollow chamber 14 in the sleeve 2 and extends from the cylinder chamber 10 to the beginning of the injection line 7. The lower end 11 of the valve body 4 projects into the cylinder chamber 10, and, at the top dead center position of the pump piston 1, touches a head portion 13 of the pump piston. The upper end 12 of the valve body 4 is guided in an intermediate part 21 having a guide bore 22. The middle portion of valve body 4 is supported in a slide guide 23 of the sleeve 2. Between the slide guide 23 and the intermediate part 21, there is a pressure chamber 24. The valve body 4 has a piston surface 25 located in the pressure chamber 24. The pressure prevailing in the pressure chamber 24 forces the valve body 4 downward toward the pump piston 1. Additionally, in the pressure chamber 24, between the piston surface 25 and the end surface of the intermediate part 21, a pressure spring 26 is installed.

Between the slide guide 23 and the upper end of the cylinder chamber 10 is arranged, around the valve body 4, an annular fuel channel 28, into which the bores 29 and 30 open. The fuel channel 28 is sealed by a valve seat 27 against the cylinder chamber 10. This valve seat 27 makes possible the suction of fuel into the cylinder chamber 10 from the fuel feed line 8 through the bore 29, the fuel channel 28 and the ring chamber 31 when the pump piston 1 moves downward. With valve seat 27 opened, on the other hand, excess fuel can flow out, from the cylinder chamber 10, through the ring chamber 31 into the fuel channel 28, and then through the bore 30 in to the fuel exit line 9. The valve body 4 with the valve seat 27 serves, therefore, at the same time as suction and as relief valve. During the work stroke of the pump piston 1, the fuel is carried from the cylinder chamber 10, through the bores 32 into the hollow core chamber 20, and from there, through the injection line 7 to the injection nozzle. At the same time, through side bores 33 in the pressure chamber 24, pressure builds up, and by impacting the piston surface 25 and the resultant difference force, the valve seat 27 is firmly closed. The fuel feed line 8 is guided in an annular channel 34 in the housing 3, which is connected with lengthwise bores 35. These lengthwise bores 35 are distributed around the housing 3, and open into a second ring channel 36, which makes the connection to the fuel exit line 9. The fuel flowing through these lengthwise bores 35 during the operation of the pump, cools the housing 3 and provides for an even distribution of heat along the entire sealing length of the pump piston 1, as well as the reduction of thermal stresses in the injection pump.

The sleeve 2 has at its upper end a fastening and sealing flange 37. The flange 37 is clamped between a contact surface 38 on the housing 3 and the end cap 5. Fastening takes place through fasteners, not shown, for example, screws which are located in the area of several axes 39. The sealing between the fastening flange 37, the contact surface 38 of the housing 3 and the end cap 5 takes place by pressing together the contact surfaces with a suitably high pressing pressure. Through this arrangement, the fuel injection pump is mechanically sealed toward the outside, and can withstand very high pressure shocks in the channel 36, with opening of the valve seat 27, at 2500 bar, for example. Moreover, the sleeve 2 is pushed into the bore 40 in the housing 3 without additional support in the axial direction. At the lower end of the sleeve 2 is a known sealing arrangement 6, through which fuel leakage is collected and carried away in the leakage line 41. The seal 6 also serves for the separation between the leakage chamber 54 and another cylinder chamber 42 in the lower portion of the housing 3. It is apparent that the sleeve 2, in this arrangement, is exposed to no additional tension forces, except the forces acting through the pump piston 1 and the pressure build-up in the cylinder chamber 10, which might lead to deformation of the cylinder chamber 10. The sleeve 2 can expand freely in the direction of the seal 6. Also, the sleeve 2 is designed completely symmetrical around the pump axis 43, which also prevents the occurrence of stress deformations. Through this arrangement, no plastic sealing rings are necessary between the housing 3 and the sleeve 2. The pressure shocks which result in the ring channel 28 with overflow of fuel at the end of carrying, can be influenced by damming up, by which a fall of pressure in the cavitation zone is prevented.

The lower end of the pump piston 1 is connected with an additional piston 44, which is guided in a cylinder chamber 42. The cylinder chamber 42 is filled with air and is connected in the known way with a compressed air supply system or a compressed air reservoir. If the pump piston 1, with the added piston 44, is moved upward, the air in the cylinder chamber 42 is slightly compressed and acts, after the pump piston 1 passes top dead center, as a return spring. Against the lower surface 45 of the additional piston 44 lies the actuating element 19 of the drive and lift establishing device, which drives the pump piston 1. The driving may take place mechanically, hydraulically or in a combined form, but it is essential that the stroke of the pump piston 1, from the top dead center position down, be measured. In this way is provided an exactly known and constant basis for the measuring of the stroke. Since the pump piston 1 must be brought, before the beginning of the operation of the injection pump, into the top dead center position, there is arranged in the housing flange 5 a relief valve 46, through which fuel can be carried away from the cylinder chamber 10, through the hollow core space 20, the beginning of the injection line 7 and the bores 47 and 48, into the leakage line 41. This relief valve 46 is actuated through the known control elements 49.

FIGS. 1 and 2 show hydraulic damping devices located at the lower end 11 and at the upper end 12 of the valve body 4. FIG. 2 shows the pump piston 1 at the top dead center position while the valve seat 27 is open. In FIG. 1, on the other hand, the valve seat 27 is closed, that is, the valve body 4 is in its lowest position, and the pump piston 1 is shown during an upward stroke. The first damping device is formed between the lower end 11 of the valve body 4 and the head part 13 of the pump piston 1. In the head part 13 of the pump piston 1 is a hollow chamber 15 of circular cross section, which is open toward the lower end 11 of the valve body 4. The diameter of the hollow chamber 15 is slightly greater than the diameter of the lower end 11 of the valve body 4, so that the lower end 11 of the valve body 4 can extend into the hollow chamber 15. Since the cylinder chamber 10 is filled with fuel, with the upward movement of the pump piston 1, there is also fuel in the hollow chamber 15. The lower end 11 of the valve body 4, extending into the hollow space 15 on the pump piston 1, forces the fuel through the annular gap 18 between the peripheral surfaces. In this way, the relative movement between the pump piston 1 and the valve body 4 is damped before the end surface 16 of the lower end 11 of the valve body 4 arrives at the bottom surface 17 in the hollow chamber 15 on the pump piston 1. Without damping, the lower end 11 of the valve body 4 could be damaged and destroyed because of the high impelling forces. With a diameter of the pump piston 1 of 30 mm, for example, the lower end 11 of the valve body 4 has a diameter of 20 mm. To obtain optimal damping properties, the hollow chamber 15 in the head part of the pump piston 1 is so dimensioned that, in the annular gap 18, a clearance of about 0.025 mm is formed. The width of the annular gap 18 may be adapted to the speed of the pump piston 1 and the maximum pressure in the cylinder chamber 10. For optimization, the depth of penetration or length of the annular gap 18 in the axial direction is varied.

The second damping device, at the upper end 12 of the valve body 4, includes the intermediate part 21 and the guide bore 22, the pressure chamber 24 and the annular piston surface 25 around the valve body 4. Between the external periphery at the upper end 12 of the valve body 4 and the internal periphery of the guide bore 22 is formed another annular gap 50 having a clearance of about 0.02 mm. During the upward movement of the pump piston 1, the valve body 4 is in its lowest position and the side bores 33 are positioned below the end surface of the intermediate part 21. The pressure built up in the cylinder chamber 10 can therefore propagate unhindered through the bores 32, the hollow core space 20 and the side bores 33 into the pressure chamber 24. This pressure acts on the annular piston surface 25 and presses the valve body 4 against the valve seat 27. As soon as the pump piston 1 or the bottom surface 17, on the head part 13, lies against the end surface 16 of the valve body 4, the valve body 4 is forced upward. With this, the openings of the side bores 33 are pushed into the guide bore 22 and closed, and in the pressure chamber 24, an increased pressure builds up through the pushing of the piston surface 25. This increased pressure acts against the upward movement of the valve body 4 and prevents it from shooting upward. With a properly dimensioned annular gap 50, enough fuel flows out of the pressure chamber 24 so that the valve body 4 and the pump piston 1 can be pushed, at the desired speed and damping into the top dead center position. With this upward movement of the valve body 4, the valve seat 27 has also been opened, and the injection pressure prevailing in the cylinder chamber 10 and the hollow core space 20 and the injection line 7 is relieved through the annular space 31 into the bore 30 and thus the fuel exit line 9. The whole system, therefore, at the top dead center position of the pump piston 1 is now only under the supply pressure of the fuel feed line system. During the suction movement of the pump piston 1, directed downward, fuel is sucked through the valve seat 27 into the cylinder chamber 10. For this, another piston surface 51 (FIG. 2) is located on the valve body 4, which is in the upper portion of the ring channel 28. The supply pressure prevailing in the ring channel 28 acts on this piston surface 51 and holds the valve seat 27 open. As soon as the pump piston 1 reaches bottom dead center, the same supply pressure as in the fuel feed line system is set in the cylinder chamber 10. This pressure acts, through the bores 32, the hollow core space 20 and the side bores 33 in the pressure chamber 24 also, by which the pressure system is equalized again at both ends of the valve body 4. At this moment, the pressure spring 26 in the pressure chamber 24 completely closes the valve seat 27, so that the pressure build-up in the cylinder chamber 10 can begin again. The total control of the suction and relief cycle, the opening and closing movement of the valve seat 27 and the damping of the movement of the pump piston 1 near top dead center, as well as the movement of the valve body 4 is obtained solely through the one-piece valve body 4. Since all the parts in the area of the valve body 4 are designed symmetrical relative to the pump axis 43, very high injection pressures can be reached with this injection pump, in the embodiment shown, for example, 2500 bar. In the example shown, for the driving of the pump piston 1, a hydraulic amplifier is used in connection with a threaded spindle and a servo motor. This known arrangement makes possible the exact measurement of the work stroke of the pump piston 1 from top dead center downward, the stroke being returned mechanically. Moreover, dependent on stroke, a reduction of the work force acting on the pump piston 1 is possible, and indeed before the valve seat 27 is opened.

Figure 3:
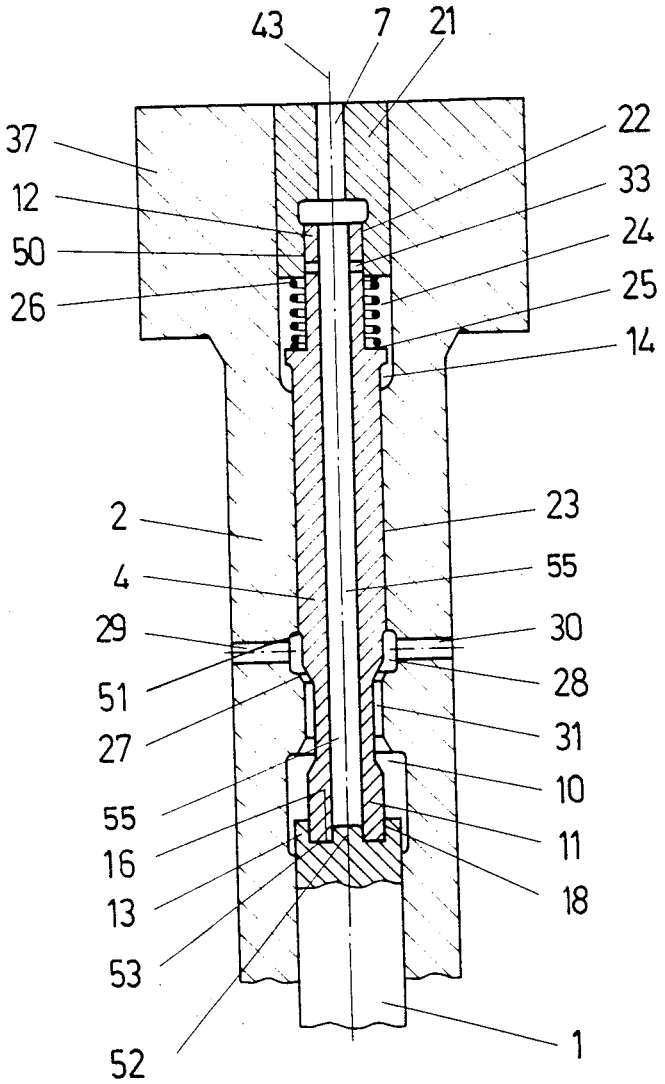
FIG. 3 is a view similar to FIG. 2 of another embodiment of the invention.

FIG. 3 shows essentially the same arrangement as FIG. 2, and the manner of operation is also similar. A hollow core space 55 extends coaxially through the valve body 4 and is open at both ends 11 and 12 of the valve body 4, in the direction of the pump axis 43. The head part 13 of the pump piston 1 is also designed differently, there being arranged in the center of the hollow chamber 15 a cylindrical projection 52. In this way, the hollow chamber 15 in the pump piston 1 has an annular bottom surface 53. Also, the foremost part of the lower end 11 of the valve body 4 has a smaller diameter than in the zone of the annular gap 18. At the end of the stroke of the pump piston 1, the projection 52 penetrates into and closes the end of the hollow core space 55 by which the damping of the movement begins through the annular gap 18. Since in the pressure chamber 24 a higher pressure results than prevails in the hollow core space 55 and the injection line 7, the damping function is obtained through the upper annular gap 50.

I claim:

1. A fuel injection pump for an internal combustion engine, in which the fuel injection pump includes a pump piston being guided in a sleeve (2), a valve arrangement located at an axial end of the pump piston and between a cylinder chamber and an injection line and including a valve body which cooperates with the pump piston when the pump piston is at a top dead center position and a device for establishing the piston stroke, with the distinction that the valve body (4) includes a lower end portion (11) extendable into the cylinder chamber (10) and an upper end portion (12) located adjacent the injection line (7) in a pump housing (3); a first hydraulic damping device located between a head part (13) of the pump piston (1) and the lower end portion (11) of the valve body (4); a second hydraulic damping device located adjacent the upper end portion (12) of the valve body (4) for braking movement of the valve body (4) in a direction away from the pump piston (1); and the valve body (4) being guided in a hollow chamber (14) in the sleeve (2) which connects the cylinder chamber (10) and the injection line (7); the second hydraulic damping device includes a pressure chamber (24) located around a portion of the valve body (4); a guide bore (22) extending from the pressure chamber (24) in which the upper end portion (12) of the valve body (4) is guided; an annular piston surface (25) located on the valve body (4) in the pressure chamber (24); and an annular gap (50) located between the exterior periphery of the upper end portion (12) of the valve body (4) and the inner periphery of the guide bore (22); the ratio of the cross-sectional area of the annular gap

(50) to the cross-sectional area of the pump piston (1) is between 1:600 and 1:1100.

2. A fuel injection pump for an internal combustion engine, in which the fuel injection pump includes a pump piston being guided in a sleeve (2), a valve arrangement located at an axial end of the pump piston and between a cylinder chamber and an injection line and including a valve body which cooperates with the pump piston when the pump piston is at a top dead center position and a device for establishing the piston stroke, with the distinction that the valve body (4) includes a lower end portion (11) extendable into the cylinder chamber (10) and an upper end portion (12) located adjacent the injection line (7) in a pump housing (3); a first hydraulic damping device located between a head part (13) of the pump piston (1) and the lower end portion (11) of the valve body (4); a second hydraulic damping device located adjacent the upper end portion (12) of the valve body (4) for braking movement of the valve body (4) in a direction away from the pump piston (1); and the valve body (4) being guided in a hollow chamber (14) in the sleeve (2) which connects the cylinder chamber (10) and the injection line (7); the second hydraulic damping device includes a pressure chamber (24) located around a portion of the valve body (4); a guide bore (22) extending from the pressure chamber (24) in which the upper end portion (12) of the valve body (4) is guided; an annular piston surface (25) located on the valve body (4) in the pressure chamber (24); and an annular gap (50) located between the exterior periphery of the upper end portion (12) of the valve body (4) and the inner periphery of the guide bore (22); the ratio of the diameter of the upper end portion (12) of the valve body (4) to the diameter of the pump piston (1) is between 1:1.5 and 1:3.

3. A fuel injection pump for supplying fuel to a fuel injection line of an internal combustion engine, said fuel injection pump comprising:

a pump housing;

a sleeve located in said pump housing, the fuel injection line being located at one axial end of said sleeve, said sleeve having a cylinder chamber located at the other axial end of said sleeve and a valve chamber interconnecting the fuel injection line and the cylinder chamber, a pump piston axially slidable within the cylinder chamber;

a valve body slidable in the valve chamber, said valve body having a passage for directing flow from said cylinder chamber, said valve body having a lower end portion extendable into the cylinder chamber and an upper end portion located adjacent the fuel injection line, said valve body being movable by said pump piston which contacts said lower end portion of said valve body and controls flow of fuel into said cylinder chamber;

first damping means independent of said passage in said valve body and located between a head part of said pump piston and said lower end portion of said valve body for damping movement between said pump piston and said valve body and thereby minimizing the force of contact between said pump piston and said valve body; and second damping means located adjacent said upper end portion of said valve body for damping movement of said valve body in a direction away from said pump piston.

4. A fuel injection pump for an internal combustion engine, in which the fuel injection pump includes a pump piston being guided in a sleeve (2), a valve arrangement located at an axial end of the pump piston and between a cylinder chamber and an injection line and including a valve body which cooperates with the pump piston when the pump piston is at a top dead center position and a device for establishing the piston stroke, with the distinction that the valve body (4) includes a lower end portion (11) extendable into the cylinder chamber (10) and an upper end portion (12) located adjacent the injection line (7) in a pump housing (3); a first hydraulic damping device located between a head part (13) of the pump piston (1) and the lower end portion (11) of the valve body (4); a second hydraulic damping device located adjacent the upper end portion (12) of the valve body (4) for braking movement of the valve body (4) in a direction away from the pump piston (1); and the valve body (4) being guided in a hollow chamber (14) in the sleeve (2) which connects the cylinder chamber (10) and the injection line (7); the first hydraulic damping device is located in the head part (13) of the pump piston (1) and has a circular hollow chamber (15) open toward the valve body (4); the diameter of the hollow chamber (15) is greater than the diameter of the lower end portion (11) of the valve body (4); a first axial end surface (16) of the valve body (4) engages a bottom surface (17) of the hollow chamber (15) when the pump piston (1) is at the top dead center position of its stroke; and an annular gap (18) is located between the external periphery of the lower end portion (11) of the valve body (4) and the internal periphery of the hollow chamber (15).

5. The fuel injection pump according to claim 4, with the distinction that the lower end portion (11) of the valve body (4) has a graduated diameter in the area of the extent of penetration into the hollow chamber (15), the greatest diameter in this area defining the annular gap (18).

6. The fuel injection pump according to claim 4, with the distinction that the ratio of the cross-sectional area of the annular gap (18) to the cross-sectional area of the pump piston (1) is between 1:500 and 1:1000.

7. The fuel injection pump according to claim 4, with the distinction that the ratio of the diameter of the first axial end portion (11) of the valve body (4) to the diameter of the pump piston (1) is between 1:1.2 and 1:2.5.

8. A fuel injection pump for an internal combustion engine, in which the fuel injection pump includes a pump piston being guided in a sleeve (2), a valve arrangement located at an axial end of the pump piston and between a cylinder chamber and an injection line and including a valve body which cooperates with the pump piston when the pump piston is at a top dead center position and a device for establishing the piston stroke, with the distinction that the valve body (4) includes a lower end portion (11) extendable into the cylinder chamber (10) and an upper end portion (12) located adjacent the injection line (7) a pump housing (3); a first hydraulic damping device located between a head part (13) of the pump piston (1) and the lower end portion (11) of the valve body (4); a second hydraulic damping device located adjacent the upper end portion (12) of the valve body (4) for damping movement of the valve body (4) in a direction away from the pump piston (1); and the valve body (4) being guided in a hollow chamber (14) in the sleeve (2) which connects the cylinder chamber (10) and the injection line (7).

9. The fuel injection pump according to claim 8, with the distinction that the valve body (4) has a hollow core space (20); the hollow core space (20) is open at the upper end portion (12) of the valve body (4); at the lower end portion (11) of the valve body (4) the hollow core space (20) is connected through side bores (32) with the cylinder chamber (10) and adjacent the guide bore (22) through side bores (33) with the pressure chamber (24).

10. The fuel injection pump according to claim 8, with the distinction that a portion of the valve body (4) is surrounded by an annular chamber (28) into which open bores (29,30) of a fuel feed line (8) and a fuel exit line (9); in an annular chamber (28) is arranged an annular piston surface (51) on the valve body (4) and on the sleeve (2) is formed an annular valve seat (27).

11. The fuel injection pump according to claim 8, with the distinction that the second hydraulic damping device includes a pressure chamber (24) located around a portion of the valve body (4); a guide bore (22) extending from the pressure chamber (24) in which the upper end portion (12) of the valve body (4) is guided; an annular piston surface (25) located on the valve body (4) in the pressure chamber (24); and an annular gap (50) located between the exterior periphery of the upper end portion (12) of the valve body (4) and the inner periphery of the guide bore (22).

12. The fuel injection pump according to claim 8, with the distinction that, at the lower end portion (11) of the pump piston (1) is arranged an additional piston (44), and the additional piston (44) is part of a fluid spring which acts against the drive stroke of the pump piston (1).

13. The fuel injection pump according to claim 8, with the distinction that an actuating element (19) of the as such known drive and control device is located adjacent an axial end of the pump piston (1).

14. The fuel injection pump according to claim 8, with the distinction that a relief valve (46) connects the injection line (7) to a fuel return and is located downstream of the valve body (4).

15. The fuel injection pump according to claim 8, with the distinction that the pump piston (1), the valve body (4) and an intermediate part (11) having a guide bore (22) are enclosed by the sleeve (2), and the sleeve (2) is made of one piece and is fastened at an axial end (37) against the pump housing (3).

16. The fuel injection pump according to claim 15, with the distinction that the sleeve (2) is at least partly enclosed by a portion of the housing (3); the housing portion has lengthwise bores (35) which are connected with a fuel feed line (8) and a fuel exit line (9), and in the operating condition are filled with fuel and an axial end of the sleeve (2) is located adjacent a pressureless leakage chamber (54) in a portion of the housing (3).

17. The fuel injection pump according to claim 18, with the distinction that the first hydraulic damping device has a circular hollow chamber (15) open toward the valve body (4); the diameter of the hollow chamber (15) is greater than the diameter of the lower end portion (11) of the valve body (4); the valve body (4) has a hollow core space (55); the hollow core space (55) is open in the axial direction at the upper end portion (12) and at the lower end portion (11) of the valve body (4) and is connected through side bores (33) with the pressure chamber (24) in the area adjacent the guide bore (22); a projection (52) extends from a surface (17) in the hollow chamber (15) of the pump piston (1) and is receivable in the hollow core space (55) at the lower end portion (11) of the valve body (4).

* * * * *